US009028371B2

(12) United States Patent
Trent

(10) Patent No.: US 9,028,371 B2
(45) Date of Patent: May 12, 2015

(54) HAND EXERCISER DEVICE

(71) Applicant: Power-Web International, Inc., Tallmadge, OH (US)

(72) Inventor: Steven C. Trent, Tallmadge, OH (US)

(73) Assignee: Power-Web International, Inc., Tallmadge, OH (US)

( * ) Notice: Subject to any disclaimer, the term of this patent is extended or adjusted under 35 U.S.C. 154(b) by 0 days.

(21) Appl. No.: 14/052,683

(22) Filed: Oct. 11, 2013

(65) Prior Publication Data

US 2014/0135179 A1 May 15, 2014

Related U.S. Application Data

(60) Provisional application No. 61/725,055, filed on Nov. 12, 2012.

(51) Int. Cl.

| | |
|---|---|
| ***A63B 23/16*** | (2006.01) |
| ***A63B 21/02*** | (2006.01) |
| ***A63B 21/00*** | (2006.01) |

(52) U.S. Cl.

CPC ..... *A63B 23/16* (2013.01); *A63B 21/00189* (2013.01); *A63B 21/0004* (2013.01); *A63B 21/1449* (2013.01)

(58) Field of Classification Search

CPC ..... A63B 21/00065; A63B 21/02; A63B 21/055; A63B 21/0555; A63B 23/14; A63B 23/16

USPC ..... 482/44–50, 121, 122, 124, 907; 601/23, 601/33, 40

See application file for complete search history.

(56) References Cited

U.S. PATENT DOCUMENTS

| | | | | |
|---|---|---|---|---|
| 4,929,211 | A * | 5/1990 | Resnick et al. | 446/14 |
| 5,299,991 | A * | 4/1994 | Sato | 482/44 |
| D385,319 | S * | 10/1997 | Lucas | D21/684 |
| 6,228,001 | B1 * | 5/2001 | Johnson et al. | 482/48 |
| 6,299,585 | B1 * | 10/2001 | Yoo | 601/118 |
| 7,121,983 | B1 * | 10/2006 | Trent | 482/47 |
| 7,381,156 | B2 * | 6/2008 | Silagy | 482/47 |
| 2002/0098958 | A1 * | 7/2002 | Watnik | 482/140 |
| 2007/0037672 | A1 * | 2/2007 | Nakanishi | 482/79 |
| 2009/0029830 | A1 * | 1/2009 | Chiang | 482/44 |
| 2009/0156367 | A1 | 6/2009 | Harris, Jr. et al. | |
| 2011/0281688 | A1 * | 11/2011 | Harris et al. | 482/44 |

* cited by examiner

*Primary Examiner* — Stephen Crow
*Assistant Examiner* — Gregory Winter
(74) *Attorney, Agent, or Firm* — Rankin, Hill & Clark LLP

(57) ABSTRACT

A hand exerciser device that includes a body having a thumb opening and a plurality of finger openings spaced apart from the thumb opening. Between the finger openings and the thumb opening, there is provided at least one and preferably a corresponding number of projections, which can be independently depressed and manipulated by the fingers.

5 Claims, 4 Drawing Sheets

HAND EXERCISER DEVICE

BACKGROUND OF INVENTION

1. Field of Invention

The present invention relates to a hand exerciser device and, more particularly, to a hand exerciser device formed of a deformable, stretchable and resilient material that provides individual finger exercising elements.

2. Description of Related Art

U.S. Pub. No. 2009/0156367 A1 discloses a hand exerciser device that is comprised of a body having a thumb opening, a plurality of finger openings spaced apart from the thumb opening and a central enlarged portion interposed between the thumb opening and the finger openings. A user can squeeze the central enlarged portion, which provides resistance to deformation. Resistance to deformation also occurs when the user spreads his or her fingers apart. The commercial embodiment of the device disclosed in U.S. Pub. No. 2009/0156367 A1 is formed of copolymeric materials that are plasticized with an oil, which exudes from the product during use and storage.

There exists substantial room for improvement in hand exerciser devices such as disclosed in U.S. Pub. No. 2009/0156367 A1. For example, it would be advantageous to be able to isolate exercises to one finger at a time rather than having to squeeze the entire central enlarged portion with all of the fingers. It would also be advantageous to form the hand exerciser from non-exuding materials.

BRIEF SUMMARY OF THE INVENTION

In view of the foregoing, the present invention is directed toward a hand exerciser comprising a body having a thumb opening and a plurality of finger openings spaced apart from the thumb opening. Between the finger openings and the thumb opening, there is provided at least one and preferably a corresponding number of projections, which can be independently depressed and manipulated by the fingers. The projections can be mounted onto an arcuate bar portion.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
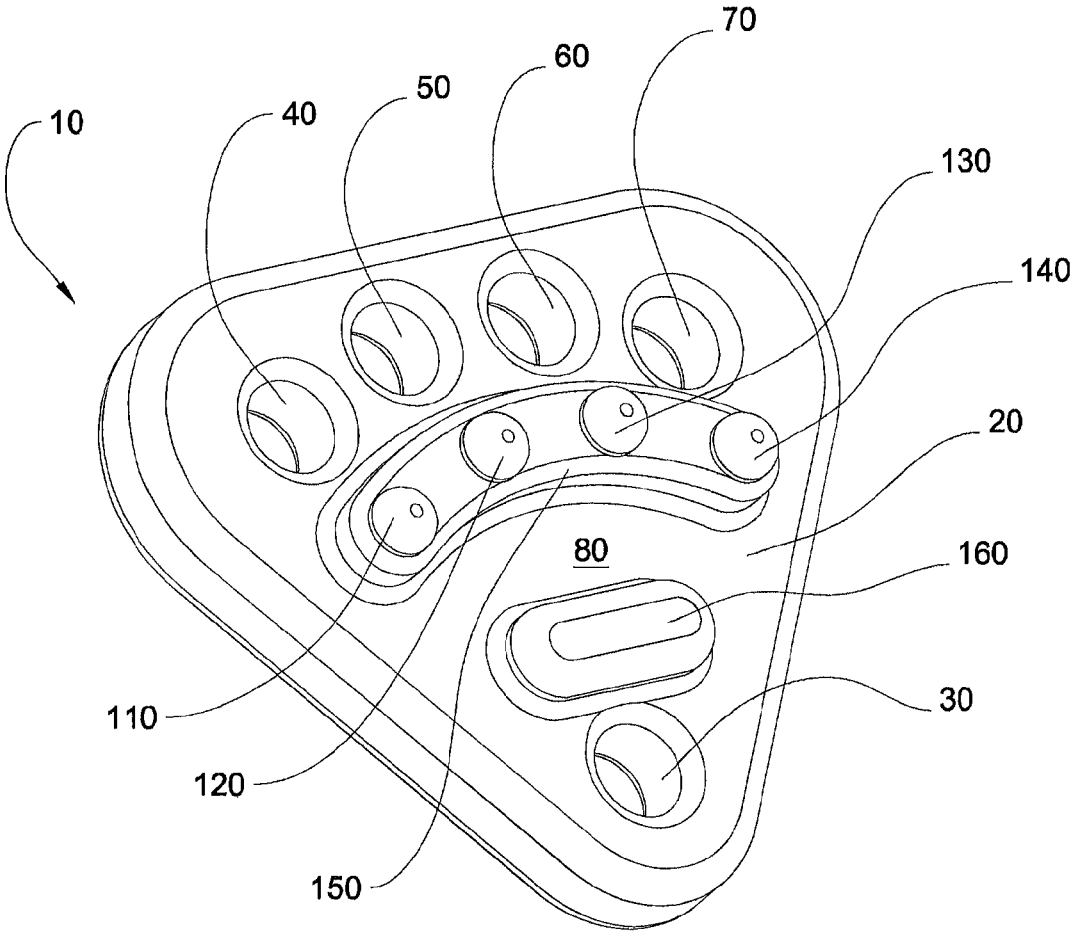
FIG. 1 is a perspective view of a preferred embodiment of a hand exerciser device according to the invention.
Figure 2:
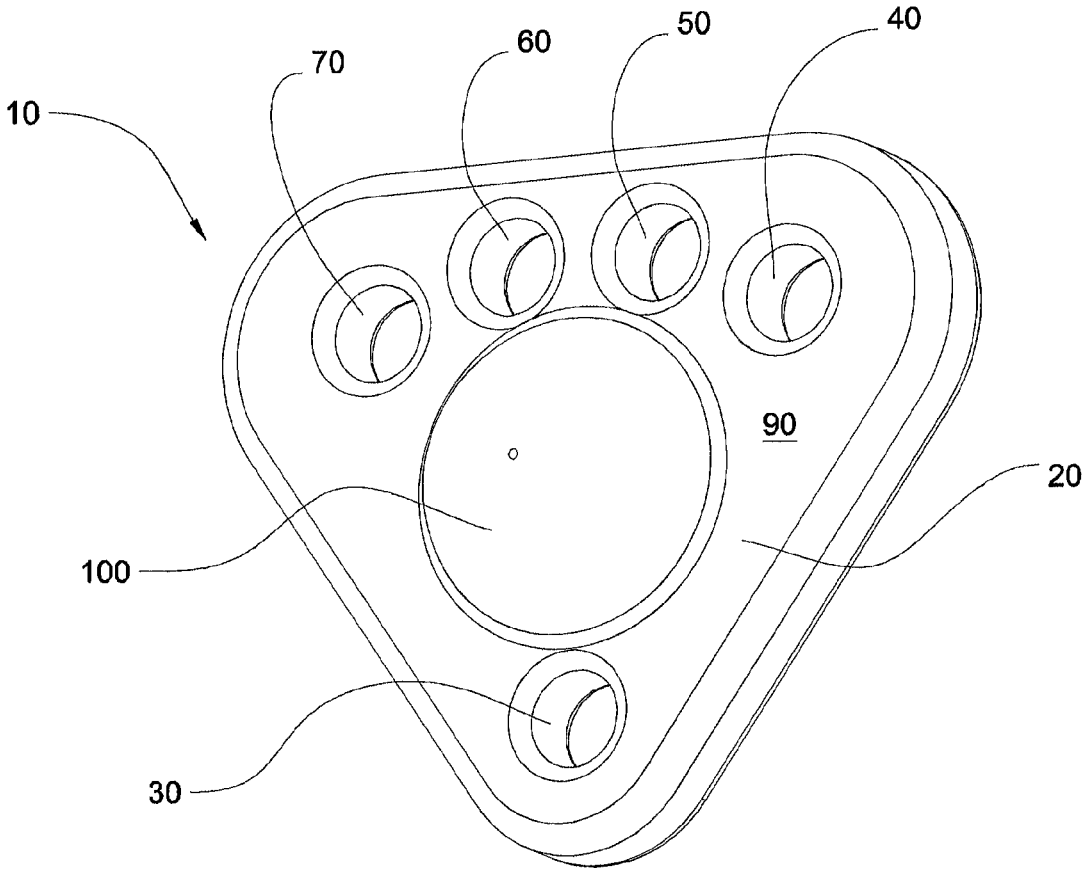
FIG. 2 is a perspective view of the other side of the hand exerciser device shown in FIG. 1.
Figure 3:
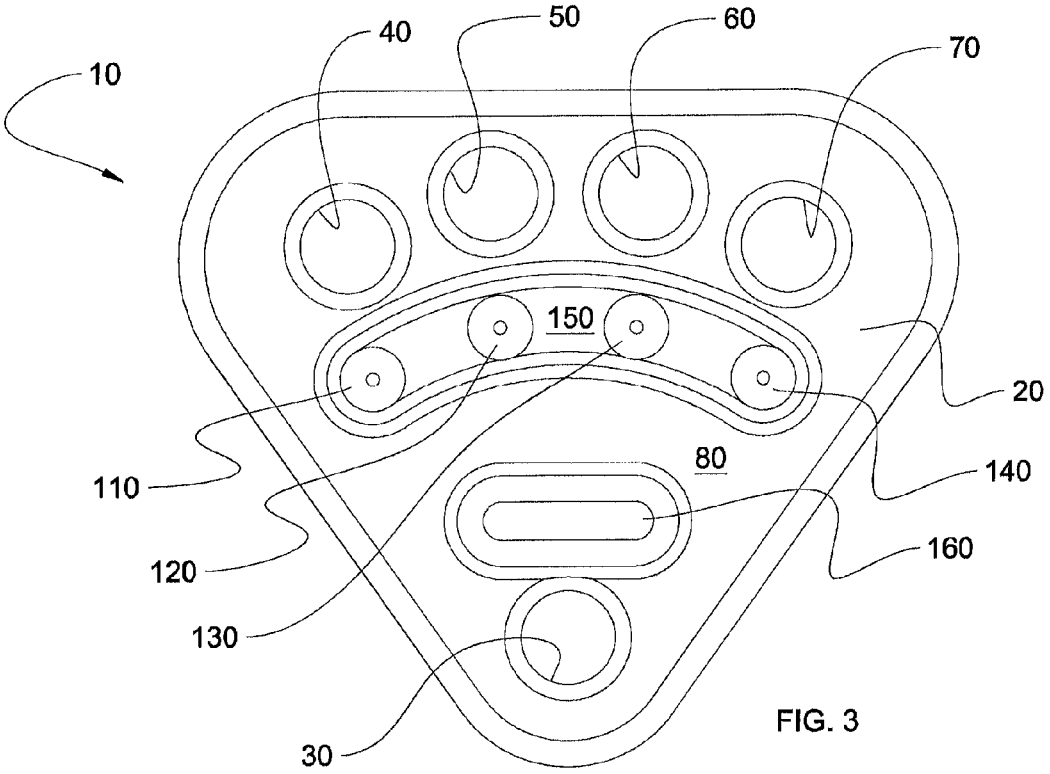
FIG. 3 is a plan view of the side of the hand exerciser device shown in FIG. 1.
Figure 4:
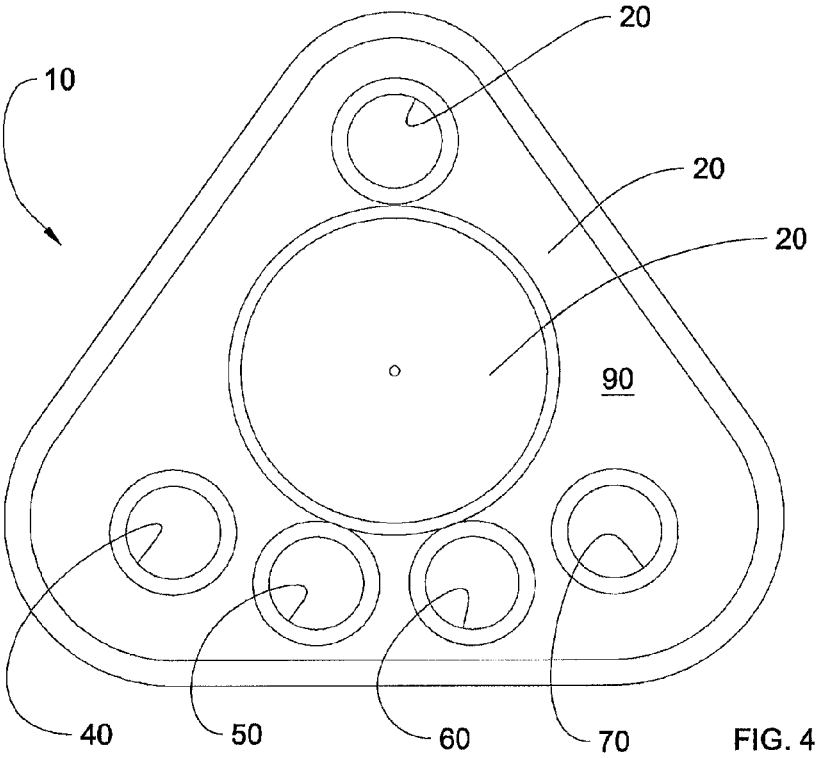
FIG. 4 is a plan view of the side of the hand exerciser device shown in FIG. 2.

A preferred embodiment of a hand exerciser device 10 according to the invention is illustrated in the accompanying figures. With reference thereto, a hand exerciser device according to the invention comprises a body portion 20 through which a plurality of holes have been provided. One hole 30 is sized for insertion of a human thumb. Spaced apart from the thumb hole are a plurality of holes for insertion of human fingers of the same hand During use with the left hand, the index finger would extend through hole 40, the middle finger through hole 50, the ring finger through hole 60 and the little finger through hole 70. During use with the right hand, the index finger would extend through hole 70, the middle finger through hole 60, the ring finger through hole 50 and the little finger through hole 40.

The body portion has a proximal side 90 and a distal side 80. The proximal side is adapted to be proximate to the palm of the user's hand when the thumb and fingers have been inserted into the respective holes in the body portion as previously described. The distal side is the side of the body portion opposite the proximal side.

A central portion 100 is provided on the proximal side of the body portion intermediate the finger holes and the thumb hole. The central portion is preferably provided as a hemispherical dome-shaped element, which is sized to be received in the palm of the user's hand and to contact the palm of the user's hand when the fingers and thumb are inserted into the holes.

A plurality of projections 110, 120, 130, 140 are provided on the distal side of the body portion between the finger holes and the thumb hole. The projections are formed nearer to the finger holes than the thumb hole. In the illustrated embodiment, one projection is spaced inwardly of each finger hole, and all of the projections are formed on a common or shared raised bar 150.

Figure 5:
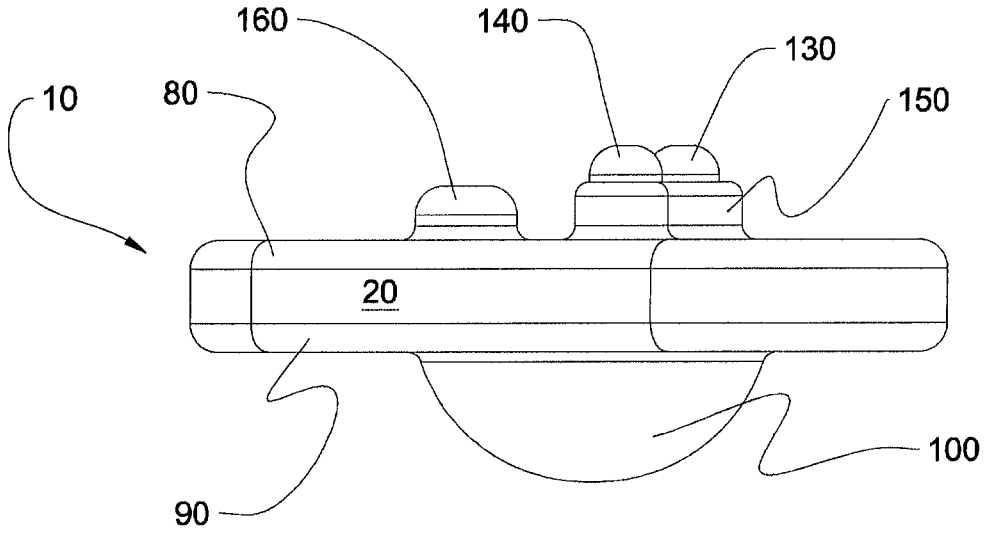
FIG. 5 is a side view of the hand exerciser device shown in the foregoing figures.

In the illustrated embodiment, a bar 160 is formed on the body portion near the thumb hole. The thumb bar, while preferred, is optional. It will be appreciated that the thumb bar could further comprise projections or have a different shape than in the accompanying figures. With particular reference to FIG. 5, the thumb bar preferably has a lower height as measured from the surface of the body portion relative to the height of the plurality of finger projections. The outer perimeter of the device preferably defines a triangle having rounded corners.

The projections are adapted to be depressed and otherwise manipulated (i.e., pushed and pulled) independently by each finger (or thumb, in the case that one or more projections is provided on the distal side of the body in a thumb region). The bar can also be manipulated by the fingers, and can be used to provide support for the projections. In the illustrated embodiments, the bar supporting the projections proximal to the finger holes is arcuate in shape, which helps insure that each projection is spaced inwardly of each finger hole approximately the same distance. In contrast to prior art hand exerciser devices which utilize only a central portion, the projections/bar(s) allow a user to independently exercise and/or rehabilitate a single finger in a variety of motions.

The hand exerciser according to the invention is preferably formed of a resilient material, which a user can deform by squeezing and/or extending the user's fingers. The resilient material can be formed of a variety of materials including, but not limited to, silicone polymers that have been plasticized with oil. Preferably, the resilient material does not exude oil onto the user's fingers during use. By varying the composition of the resilient material (e.g., by increasing or decreasing the plasticizer content), one can obtain a variety of devices having the same dimensions that provide different levels of resistance.

In another aspect of the invention, a plurality of hand exerciser devices are provided as a kit. Preferably, at least two of the hand exerciser devices in the kit exhibit a different resistance (e.g., by being made of materials having a different resiliency), which allows a user to gradually improve his or her strength by selecting hand exerciser devices that provide greater resistance. The hand exercisers in the kit can be color coded. For example, a hand exerciser devices providing the least resistance to the most resistance could be color coded yellow, red, green, blue and black, respectively.

Preferably, hand exerciser devices according to the invention are formed of a unitary piece of resilient material. However, it will be appreciated that the central portion and/or the projections could be independently removable and replaceable, if desired.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A hand exerciser formed of resilient material comprising a body portion having a proximal side and an opposing distal side, wherein said body portion is provided with a thumb hole and four additional separate and distinct finger holes through which a user can insert the user's thumb and four fingers, respectively, wherein an arcuate raised bar is provided on the distal side of the body portion intermediate the thumb hole and the finger holes, wherein four projections are formed on the arcuate raised bar, wherein the four projections are formed nearer to the finger holes than the thumb hole, wherein each of said four projections is spaced inwardly of a corresponding finger hole approximately the same distance, wherein each of said four projections is configured to be independently depressed and manipulated by the user's fingers, and wherein a hemispherical dome-shaped element is provided on the proximal side of the body portion intermediate the finger holes and the thumb hole.

2. The hand exerciser according to claim 1, further comprising a raised thumb bar on the distal side of the body portion adjacent to the thumb hole, said raised thumb bar being separate and distinct from the arcuate raised bar on which said four projections are formed.

3. The hand exerciser according to claim 2, wherein the thumb bar has a height that is lower than a height of the plurality of projections on the arcuate raised bar.

4. A kit comprising a plurality of hand exercisers according to claim 1, wherein at least two of the hand exercisers exhibit a different resiliency.

5. A method of exercising one or more fingers of a user's hand, the method comprising:

providing a hand exerciser according to claim 1 to a user;

inserting the user's fingers and thumb through the thumb hole and finger holes of the hand exerciser; and manipulating one or more of the projections using the fingers.

* * * * *